US008447439B2

(12) United States Patent
Chen

(10) Patent No.: US 8,447,439 B2
(45) Date of Patent: May 21, 2013

(54) THREE-WAY AIRPLANE MODEL CONTROL SYSTEM WITH 2.4G COMMUNICATION MODE

(76) Inventor: Dong Xian Chen, Guangdong (CN)

( * ) Notice: Subject to any disclaimer, the term of this patent is extended or adjusted under 35 U.S.C. 154(b) by 215 days.

(21) Appl. No.: 13/052,133

(22) Filed: Mar. 21, 2011

(65) Prior Publication Data

US 2012/0245761 A1 Sep. 27, 2012

(51) Int. Cl.
*G05D 1/00* (2006.01)

(52) U.S. Cl.
USPC ..... 701/2; 446/37; 244/17.21

(58) Field of Classification Search
USPC ..... 701/2; 244/17.21; 466/37; 375/135; 446/225, 454, 484, 330, 37; 180/65.1; 709/217; 434/32, 30; 381/334; 340/944; 700/248, 264; 901/2; 318/568.11
See application file for complete search history.

(56) References Cited

U.S. PATENT DOCUMENTS

2008/0220687 A1* 9/2008 Taya ..... 446/37
2012/0187238 A1* 7/2012 Lam ..... 244/17.21

* cited by examiner

*Primary Examiner* — Behrang Badii

(57) ABSTRACT

The utility model provides an airplane model control system capable of conducting omnidirectional and long-distance transmission of signals without being interfered by the sunlight and other visible lights. The airplane model control system can transverse obstacles for data communication, and comprises a remote control transmitting control device and an airplane receiving control device which all work in the frequency band of 2.4 GHz and 83 communication channels are included; and each remote control transmitting control device has unique ID number, which will not be controlled and interfered due to the reason of same frequency, realizes a share port of multiple functions simultaneously on one main controller and can realize reduction of cost.

7 Claims, 5 Drawing Sheets

THREE-WAY AIRPLANE MODEL CONTROL SYSTEM WITH 2.4G COMMUNICATION MODE

TECHNICAL FIELD

The utility model belongs to the field of wireless communication control of a toy model, and particularly relates to a wireless radio-frequency communication control system of an airplane model.

BACKGROUND TECHNOLOGY

In various toy models with remote control functions, most of the existing toys adopt the traditional infrared or common low-frequency RF remote controllers such as 27 Mhz, 35 Mhz, 47 Mhz and the like, but undoubtedly, there are defects in the infrared remote control, for example, the communication can be conducted only by keeping the transmitting angle to be in 45 degree and close distance, and the results of communication interference or even failure under the interference of the sunlight and other visible lights and communication failure when obstacles are encountered and the like can be caused. In terms of the freedom of machine operation, two-way communication and elasticity of product design, the wireless radio frequency (RF) remote control is far more than the infrared remote control, but the common low-frequency RF remote controller only has three communication IDs with the same communication frequency, and is very easy to generate same frequency interference in the use process while having a plurality of models; and the transmission rate of system data is low, the response of the airplane can be more lagged than the control action, and the common RF type remote control airplane models are all restricted without breaking through restriction.

SUMMARY OF THE INVENTION

The utility model aims at providing airplane model control system capable of conducting omnidirectional and long-distance transmission of signals without being interfered by the sunlight and other visible lights. The airplane model control system can transverse obstacles for data communication simultaneously, will not be controlled and interfered due to the reason of same frequency, realizes a share port of multiple functions simultaneously on one main controller and can realize reduction of cost.

The three-way airplane model control system of the utility model comprises two parts, namely the remote control transmitting device and the airplane receiving control device, wherein the remote control transmitting device comprises the joystick input end, the status indicating lamp and the first memory which are respectively connected with the first MCU; and the airplane receiving control device comprises the control signal output end, the LED indicating lamp and the second memory which are respectively connected with the second MCU. The remote control transmitting device further comprises the 2.4G radio-frequency (RF) transmitting module, the pairing key and the fine tuning key which are respectively connected with the MCU. The airplane receiving control device further comprises the 2.4G radio-frequency (RF) receiving module and the gyroscope which are respectively connected with the MCU.

The fine tuning key comprises two keys, wherein one end of the first key is connected with the first I/O port of the first MCU, and the other end thereof is grounded; one end of the second key is connected with the first I/O port of the first MCU, and the other end thereof is connected with a power supply end by a resistor.

The cathode of the status indicating lamp is connected with the power supply end by the resistor, the anode thereof is grounded by a triode, and the base of the triode is connected with the SDA end of the first MCU.

The LED indicating lamp and the battery power end in the airplane receiving control device are respectively connected to the LED indicating control end in the second MCU by a resistor.

The 2.4G radio-frequency (RF) transmitting module and the 2.4G radio-frequency (RF) receiving module work in the frequency band of 2.4GHz, 83 communication channels are included, each channel occupies 1 Mhz bandwidth, the working frequency of each communication channel is different, and each remote control transmitting device has the unique ID number; during the pairing, the communication parameters of the remote control transmitting device are matched with the communication parameters of the airplane receiving control device, then the airplane receiving control device only receives the signals transmitted from the paired remote control transmitting device and ignores the signals transmitted by other remote control transmitting control devices.

The SDA end in the first MCU is respectively connected with a data port of the first memory, the CE foot of the 2.4G radio-frequency (RF) transmitting module and the status indicating lamp; and the MOSI end is connected with the control switch for controlling the speed of forward and backward functions.

The SDA end in the second MCU is respectively connected with a data port of the second memory and the CE foot of the 2.4 G radio-frequency (RF) transmitting module.

The utility model has the benefits that: based on the development of the 2.4G communication mode, omnidirectional and long-distance transmission of signals can be conducted without being limited by signal transmitting direction and near-distance operation of remote control, is not interfered by the sunlight and other visible lights and transverses obstacles for data communication; the transmission rate of system data is fast; the remote controller transmits a group of data to the airplane at every 10 MS, and the action of the remote controller can be accurately synchronous with the reaction of the airplane; because each remote controller has the unique ID number, and during the pairing the remote controller is matched with the airplane on communication parameters, then the airplane only receives the signals transmitted by the paired remote controllers, and ignores the signals transmitted by other remote controllers; 20 remote controllers can work simultaneously without mutual interference; and multiple functions can be realized simultaneously by the I/O port on the main controller, so chip pins are saved, and simultaneously the cost is also effectively reduced.

Further detailed descriptions of the utility model are made by combining the attached drawings and the embodiments.

SPECIFICATION OF THE DRAWINGS

DESCRIPTION OF THE DETAILED EMBODIMENT

Figure 1:
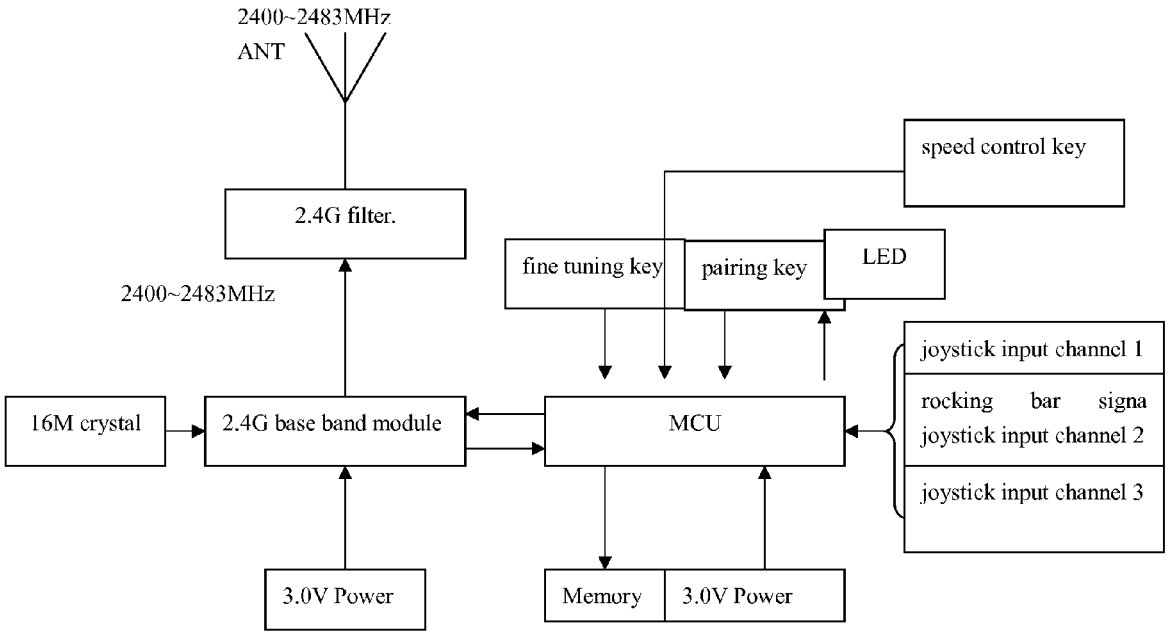
FIG. 1 is a structure diagram of the remote control transmitting device of the utility model.
Figure 2:
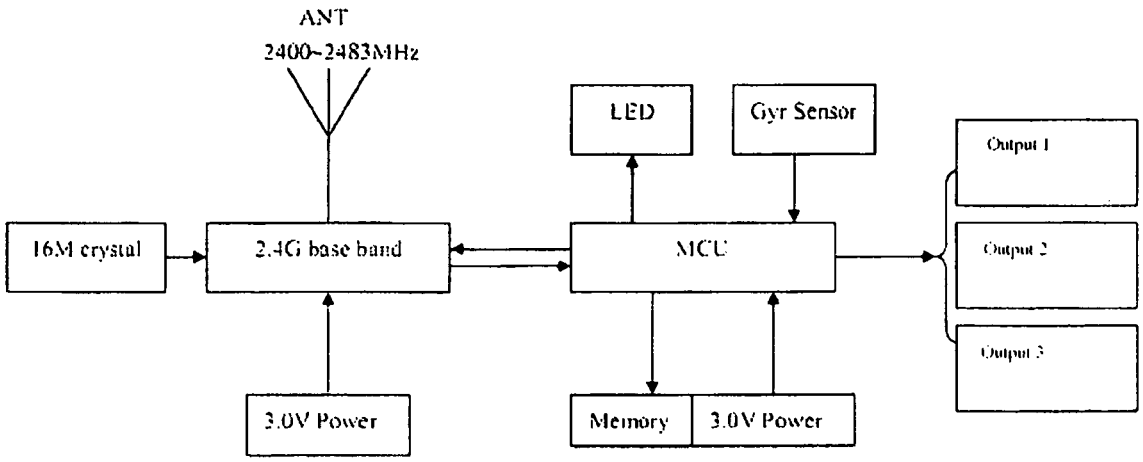
FIG. 2 is a structure diagram of the airplane receiving control device of the utility model.

The three-way airplane model control system, as shown in FIG. 1 and FIG. 2, comprises two parts, namely, a remote control transmitting device and an airplane receiving control device, wherein the remote control transmitting device comprises three joystick input ends, the status indicating lamp and the first memory (remote control transmitting control memory) which are respectively connected with the first MCU; and the airplane receiving control device comprises the control signal output end, the battery voltage indicating lamp and the second memory (airplane receiving control memory) which are respectively connected with the second MCU. The remote control transmitting device further comprises the 2.4G radio-frequency (RF) transmitting module, the speed control key, the pairing key and the fine tuning key which are respectively connected with the MCU. The airplane receiving control device further comprises the 2.4G radio-frequency (RF) receiving module and the gyroscope (gyro) which are respectively connected with the MCU.

Figure 3:
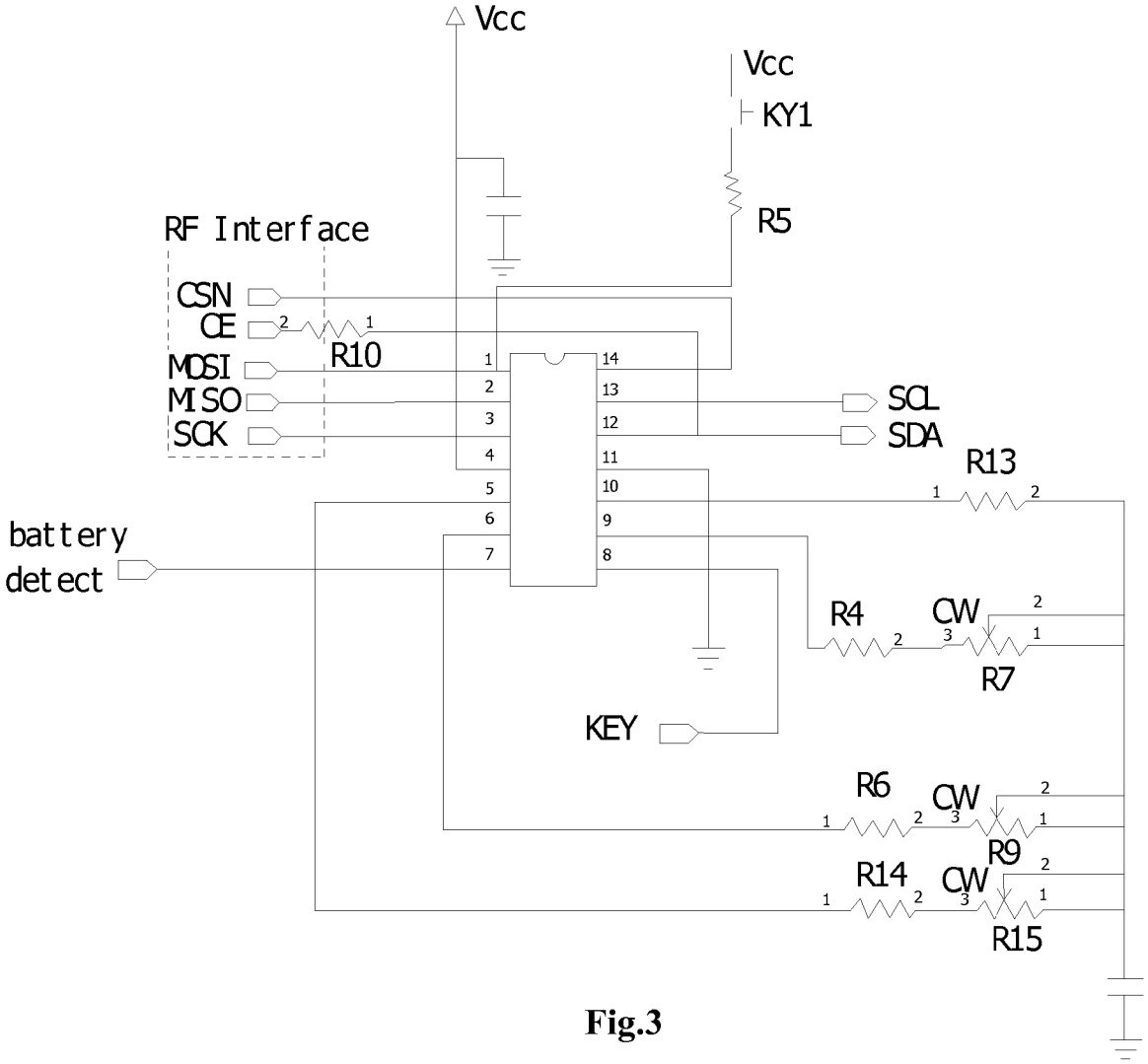
FIG. 3 is a connecting circuit diagram of the MCU in the remote control transmitting device of the utility model.

As shown in FIG. 3, the SDA in the first MCU is respectively connected with the data port of the remote control transmitting control memory, the CE foot of the 2.4G radio-frequency (RF) transmitting module and the status indicating lamp D2; and the MOSI can realize the function of controlling the forward and backward speed of the airplane model according to the on or off of the control switch KY1.

Figure 4:
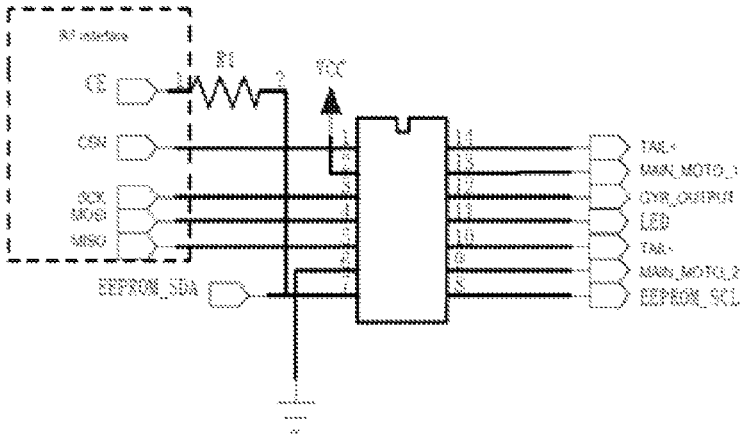
FIG. 4 is a connecting circuit diagram of the MCU in the airplane receiving control device of the utility model.

As shown in FIG. 4, the SDA end in the second MCU is respectively connected with the data port of the second memory and the CE foot of the 2.4G radio-frequency (RF) transmitting module.

Figure 5:
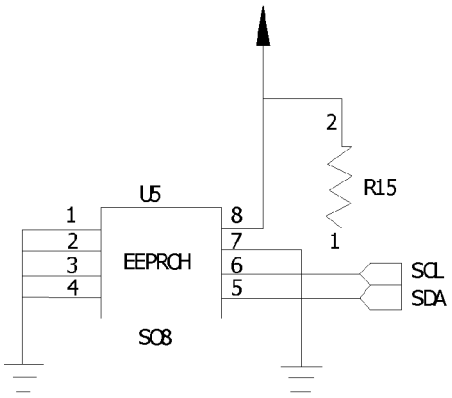
FIG. 5 is a connecting circuit diagram of the first memory in the remote control transmitting device of the utility model.

The FIG. 5 is the circuit connection diagram of the remote control transmitting control memory and the airplane receiving control memory, wherein the SDA end is respectively connected with the SDA end of the first MCU and the EEPROM_SDA end of the second MCU.

Figure 6:
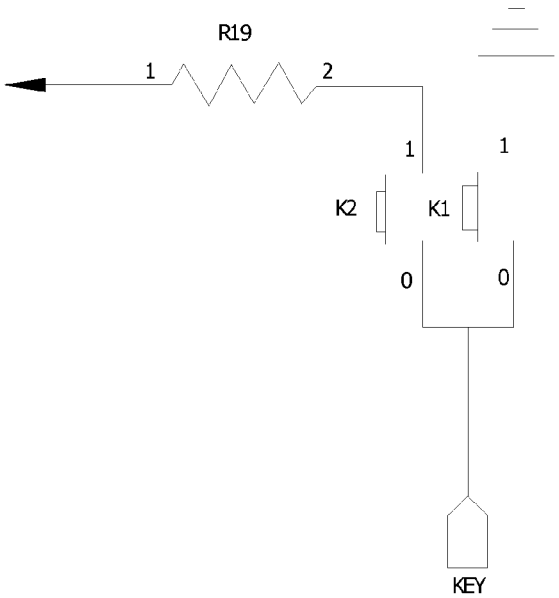
FIG. 6 is a connecting circuit diagram of the fine tuning key of the utility model.

The fine tuning key comprises two keys, and by reference of the FIG. 6 and the FIG. 3, one end of the key is connected with eight feet of the MCU in the remote control transmitting control device, and the other end thereof is grounded; and one end of the key K2 is connected with the eight feet of the MCU in the remote control transmitting control device, and the other end thereof is connected with the power supply end by the resistor R19.

Figure 7:
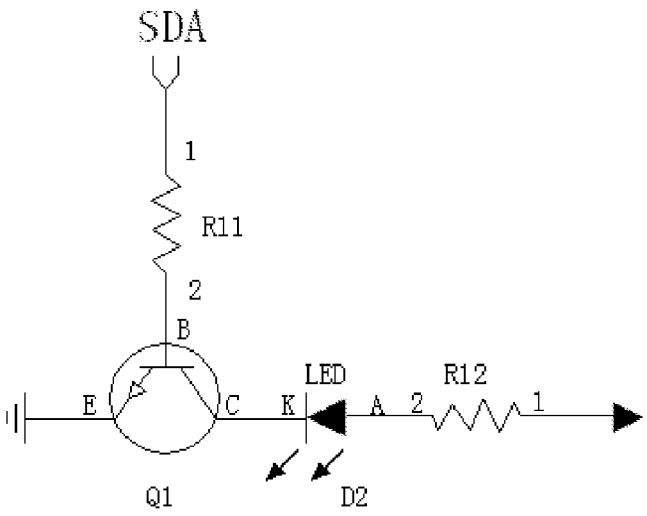
FIG. 7 is a connecting circuit diagram of the status indicating lamp of the utility model.

As shown in FIG. 7, the cathode of the status indicating lamp D2 is connected with the power supply end by the resistor R12, and the anode thereof is grounded by the triode Q1; and the SDA end of the first MCU is connected with the base of the triode Q1 by the resistor 11, and simultaneously shares the same pin with the EEPROM.

Figure 8:
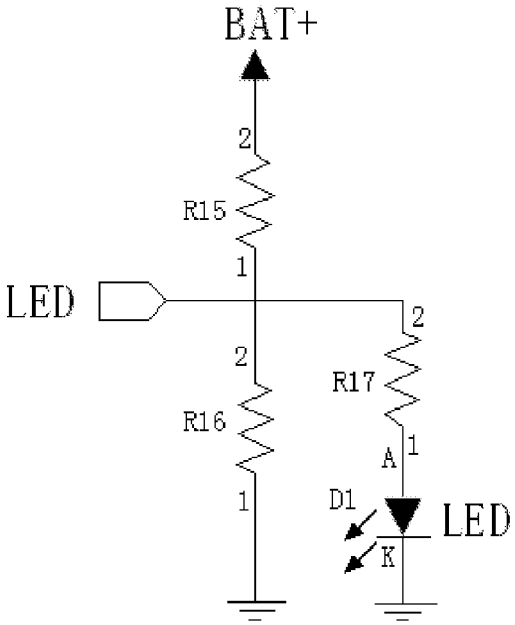
FIG. 8 is a connecting circuit diagram of the LED indicating lamp of the utility model.

As shown in FIG. 8, the LED indicating lamp D1 and the power supply end in the airplane receiving control device are respectively connected to the LED of the LED indicating control end in the second MCU by the resistors R17 and R15. While the R15 and R16 play a role in low voltage detection respectively, therefore, the pin is also used as two functions, saves one pin on the whole and achieves the advantage of controlling the cost.

The 2.4G radio-frequency (RF) transmitting module and the 2.4G radio-frequency (RF) receiving module work in the frequency band of 2.4GHz, 83 communication channels are included, each channel occupies 1Mhz bandwidth, the working frequency of each communication channel is different, and each remote control transmitting device has the unique ID number; and during the pairing the communication parameters of the remote control transmitting device are matched with the communication parameters of the airplane receiving control device, and then the airplane receiving control device only receives the signals transmitted from the paired remote control transmitting device and ignores the signals transmitted by other remote control transmitting control devices.

In conclusion from the above functions, the solution provides a control function for adopting the MCU with 14PINs to realize the three-channel airplane.

The above embodiment of the utility model is only the preferred embodiment of the utility model, and is not used for limiting the utility model, and all modifications, alterations or improvements and the like made on the basis of the utility model, for example, similar elements are replaced for realizing the same effect, are all in the protection scope of the utility model.

The invention claimed is:

1. A three-way airplane model control system comprises a remote control transmitting device and an airplane receiving control device, wherein the remote control transmitting device comprises a joystick input end, a status indicating lamp and a first memory which are respectively connected with a first MCU; and the airplane receiving control device comprises a control signal output end, a battery voltage indicating lamp and a second memory which are respectively connected with a second MCU; the three-way airplane model control system is characterized in that the remote control transmitting device further comprises a 2.4G radio-frequency (RF) transmitting module, a speed control key, a pairing key and a fine tuning key which are respectively connected with the MCU; and, the airplane receiving control device further comprises a 2.4G radio-frequency (RF) receiving module and a gyroscope which are respectively connected with the MCU.

2. The three-way airplane model control system according to claim 1, wherein the 2.4G radio-frequency (RF) transmitting module and the 2.4G radio-frequency (RF) receiving module work in the frequency band of 2.4GHz, 83 communication channels are included, and each channel occupies 1 Mhz bandwidth.

3. The three-way airplane model control system according to claim 1, wherein a first I/O port in the first MCU is respectively connected with a data port of the first memory, a CE foot of the 2.4G radio-frequency (RF) transmitting module and the status indicating lamp.

4. The three-way airplane model control system according to claim 1, wherein a first I/O port in the second MCU is respectively connected with a data port of the second memory and a CE foot of the 2.4G radio-frequency (RF) transmitting module.

5. The three-way airplane model control system according to claim 1, wherein an LED indicating lamp and a battery power end of the airplane receiving control device are respectively connected to an LED indicating control end in the second MCU by a resistor.

6. The three-way airplane model control system according to claim 1, wherein the fine tuning key comprises two keys, one end of the first key is connected with the first I/O port of the first MCU, and the other end thereof is grounded; and one end of the second key is connected with the first I/O port of the first MCU, and the other end thereof is connected with a power supply end by a resistor.

7. The three-way airplane model control system according to claim 1, wherein the speed control key comprises a switch, a resistor and a voltage supply end which is respectively connected to an MOSI port of the RF transmitting module by the switch and the resistor.

* * * * *